US011331249B2

(12) United States Patent
Flynn et al.

(10) Patent No.: US 11,331,249 B2
(45) Date of Patent: May 17, 2022

(54) DEVICES FOR DELIVERING AN AGENT INTO BREASTMILK AND ASSOCIATED SYSTEMS AND METHODS

(71) Applicant: JustMilk, Temecula, CA (US)

(72) Inventors: Aspen D. Flynn, Oakland, CA (US); Geoff M. Galgon, Newport Beach, CA (US); Stephen E. Gerrard, Altrincham (GB); Sean C. Ross, Berkeley, CA (US); Rebekah L. Scheuerle, Cambridge (GB)

(73) Assignee: JustMilk, Laguna Beach, CA (US)

( * ) Notice: Subject to any disclaimer, the term of this patent is extended or adjusted under 35 U.S.C. 154(b) by 26 days.

(21) Appl. No.: 16/085,170

(22) PCT Filed: Mar. 16, 2017

(86) PCT No.: PCT/US2017/022836

§ 371 (c)(1),
(2) Date: Sep. 14, 2018

(87) PCT Pub. No.: WO2017/161203

PCT Pub. Date: Sep. 21, 2017

(65) Prior Publication Data

US 2019/0060180 A1 Feb. 28, 2019

Related U.S. Application Data

(60) Provisional application No. 62/424,006, filed on Nov. 18, 2016, provisional application No. 62/337,805,
(Continued)

(51) Int. Cl.
*A61J 13/00* (2006.01)
*A61J 7/00* (2006.01)

(52) U.S. Cl.
CPC ..... *A61J 13/00* (2013.01); *A61J 7/0053* (2013.01)

(58) Field of Classification Search
CPC ..... A61J 13/00; A61J 17/006; A61J 11/0005; A61J 11/005; A61J 11/0035; A61M 1/064; A61M 1/066
See application file for complete search history.

(56) References Cited

U.S. PATENT DOCUMENTS 322,508 A * 7/1885 Ware ..... A61J 13/00 604/76
2,364,866 A * 12/1944 Meynier, Jr. ..... A61J 13/00 128/890

(Continued)

FOREIGN PATENT DOCUMENTS

GB 191517675 A * 10/1916 ..... A61J 13/00
WO 2017161203 9/2017
WO 2019050537 3/2019

OTHER PUBLICATIONS

Justmilk, "JUSTMILK.org Device Use Animation", Aug. 2, 2013, Youtube, <<https://www.youtube.com/watch?v=FhNmm0_aZ9s>>, Accessed Aug. 2, 2021 (Year: 2013).*

(Continued)

*Primary Examiner* — William R Carpenter
(74) *Attorney, Agent, or Firm* — Perkins Coie LLP

(57) ABSTRACT

The present technology is a device for delivering a medicinal agent to a breastfeeding child. One embodiment comprises a first portion configured to be positioned on the breast during breastfeeding a second portion having an agent region and a sealing region. The agent region is configured to house the agent during breastfeeding and has a first cross-sectional area. The sealing region has a second cross-sectional area at least great enough to surround and engage a circumference of the nipple but less than the first cross- (Continued)

sectional area. When the device is positioned on the breast and the child is breastfeeding, the device is configured such that the nipple extends through the sealing region into the agent region and the portion of the delivery device at the sealing region contacts the nipple, thereby reducing or preventing the flow of breast milk and/or the agent through the sealing region to the first portion.

16 Claims, 6 Drawing Sheets

Related U.S. Application Data filed on May 17, 2016, provisional application No. 62/309,375, filed on Mar. 16, 2016.

(56) References Cited

U.S. PATENT DOCUMENTS 2,876,773 A * 3/1959 Witz ..... A61J 11/002 215/11.4
3,082,770 A * 3/1963 Straub ..... A61J 11/006 215/11.1
5,573,507 A * 11/1996 Moser ..... A47G 21/18 215/11.1
6,491,666 B1 12/2002 Santini, Jr. et al.
7,578,403 B2 * 8/2009 Tamura ..... A61J 11/004 215/11.1
8,357,117 B2 1/2013 Sokal et al.
8,545,477 B2 10/2013 Burke et al.
9,987,197 B2 * 6/2018 Itzek ..... A61J 11/006
2002/0129816 A1 9/2002 Williams et al.
2004/0182813 A1 * 9/2004 Gilmore ..... A61J 11/005 215/11.4
2005/0059927 A1 * 3/2005 Buiatti ..... A61J 13/00 604/74
2009/0124967 A1 * 5/2009 Zucker-Franklin ..... A61J 11/0025 604/76
2010/0292637 A1 * 11/2010 Sokal ..... A61J 7/0053 604/76
2011/0065360 A1 * 3/2011 Francis ..... A61J 13/00 450/81
2011/0108504 A1 5/2011 Gust
2012/0165729 A1 * 6/2012 Cudworth ..... A61J 13/00 604/74
2012/0165730 A1 * 6/2012 McCoy ..... A61J 13/00 604/76
2016/0220451 A1 * 8/2016 Blank ..... A61J 13/00
2016/0287481 A1 10/2016 Chin et al.
2020/0206083 A1 7/2020 Scheuerle et al.

OTHER PUBLICATIONS

International Preliminary Report on Patentability received for International Application No. PCT/US2017/050836; Applicant: JUSTMILK, dated Mar. 19, 2020, 8 pages.
International Search Report and Written Opinion received for International Application No. PCT/US2017/050836 Applicant: JUSTMILK, dated Jun. 1, 2018, 11 pages.
International Search Report and Written Opinion received for International Application No. PCT/US2017/022836 Applicant: JUSTMILK, dated Jun. 30, 2017, 2020, 14 pages.
International Preliminary Report on Patentability received for International Application No. PCT/US2017/022836 Applicant: JUSTMILK, dated Sep. 27, 2018, 2018, 10 pages.
Hart, Catherine W. et al., "Acceptability of a nipple shield delivery system administering antiviral agents to prevent mother-to-child transmission of HIV through breastfeeding," Journal of Human Lactation, 2015, vol. 31, Issue 1, pp. 68-76.
Gerrard, Stephen et al. "A nipple shield delivery system for oral drug delivery to breastfeeding infants: Microbicide delivery to inactivate HIV," International Journal of Pharmaceutics, 2012, vol. 434, Issue 1-2, pp. 222-234.

* cited by examiner

DEVICES FOR DELIVERING AN AGENT INTO BREASTMILK AND ASSOCIATED SYSTEMS AND METHODS

CROSS-REFERENCE TO RELATED APPLICATIONS

The present application is a 35 U.S.C. § 371 U.S. National Phase application of International Patent Application No. PCT/US2017/022836, filed Mar. 16, 2017, which claims the benefit of U.S. Patent Application No. 62/309,375, filed Mar. 16, 2016, U.S. Patent Application No. 62/337,805, filed May 17, 2016, and U.S. Patent Application No. 62/424,006, filed Nov. 18, 2016, all of which are incorporated by reference herein in their entireties.

TECHNICAL FIELD

The present technology relates generally to devices and methods for delivering a medicinal agent into breast milk.

BACKGROUND

In 2015, 4.5 million infants died, 2.7 million of which died within the first month of life. Many of these deaths could have been prevented with access to and proper administration of appropriate therapeutics. Among infants who survive, millions more suffer from levels of undernutrition that harm their development and imperil their futures. In 2014, of the 667 million children in the world under five years of age, 159 million were stunted and 50 million were wasted, of whom 16 million were severely wasted. Assuring proper infant nutrition with access to appropriate forms of therapeutics is therefore of critical importance; this is also illustrated by indicators for at least twelve of the seventeen Sustainable Development Goals being closely tied to nutrition. Lifelong effects reach far beyond health outcomes: in Africa and Asia in 2016, malnutrition represents an estimated loss of 11% GDP annually. Accordingly, there exists a need for low cost devices, systems, and methods for delivering agents that are therapeutic and/or a dietary supplement to children.

BRIEF DESCRIPTION OF THE DRAWINGS

Many aspects of the present disclosure can be better understood with reference to the following drawings. The components in the drawings are not necessarily to scale, and instead emphasis is placed on illustrating clearly the principles of the present disclosure. Furthermore, components can be shown as transparent in certain views for clarity of illustration only and not to indicate that the illustrated component is necessarily transparent. For ease of reference, throughout this disclosure identical reference numbers and/or letters are used to identify similar or analogous components or features, but the use of the same reference number does not imply that the parts should be construed to be identical. Indeed, in many examples described herein, identically numbered components refer to different embodiments that are distinct in structure and/or function. The headings provided herein are for convenience only.

FIG. 4B shows a cross-sectional view of the device, FIG. 4C shows the view of a full delivery device.

DETAILED DESCRIPTION

Figure 1B:
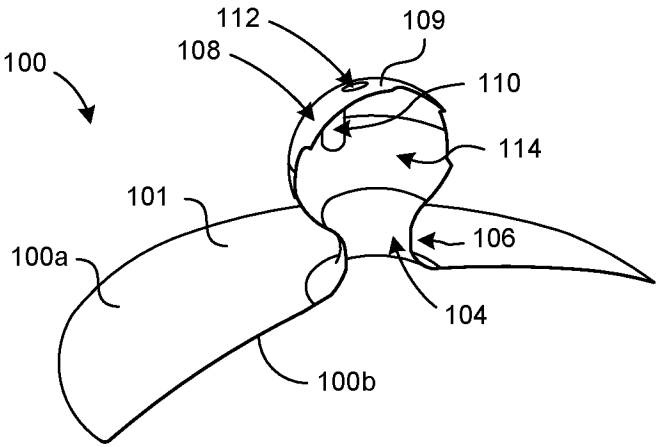
FIG. 1B is a perspective, cross-sectional view of the delivery device shown in FIG. 1A.

Several embodiments of the present technology are directed to devices for delivering a medicinal agent to a breastfeeding child. In particular, many embodiments of the present technology are directed to delivery devices configured to be worn by a female during breastfeeding. Specific details of several embodiments of the technology are described below with reference to FIGS. 1A-5G. Although many of the embodiments are described below with respect to devices for delivering a medicinal agent to a human child through breast milk, other applications and other embodiments in addition to those described herein are within the scope of the technology. For example, the delivery devices of the present technology can be used for delivering a substance to an animal. It will be appreciated that any of the embodiments of delivery devices disclosed herein may not necessarily incorporate the flow of breast milk in the medication delivery process. Additionally, several other embodiments of the technology can have different configurations, components, or procedures than those described herein. A person of ordinary skill in the art, therefore, will accordingly understand that the technology can have other embodiments with additional elements, or the technology can have other embodiments without several of the features shown and described below with reference to FIGS. 1A-5G.

Definitions

With regard to the terms "distal" and "proximal" within this description, unless otherwise specified, the terms can reference a relative position of the portions of a delivery device or associated component with reference to the breast of a breastfeeding female when the delivery device is positioned on the breast during breastfeeding. For example, in referring to a delivery device, "proximal" can refer to a position closer to the breast, and "distal" can refer to a position that is more distant from the breast.

As used herein, the term "medicinal agent" or "agent" may include a therapeutic which is efficacious in the treatment and/or prevention of generalized or localized pain, allergic reactions, seizure, infection (e.g., parasitic, bacterial, leprotic, tuberculotic, fungal, viral, retroviral, hepatic, protozoal, and/or of another sort), migraine, immune system disorders, imbalances, or autoimmune disease, hormonal imbalances, endocrine disorders, anaemia, haemoglobinopathies, hypertension, lipid disorders, dermatological disease (e.g., fungal, infective, pruritic, or scabicidal), ophthalmic disease, sepsis, gastrointestinal disease (e.g. ulcers, vomiting, nausea, constipation), diarrhea, dehydration, poisoning, venom toxicity, inflammation, psychosis, mood disorders, depression, psychiatric disorders, asthma, electrolyte and acid-base disturbances, vitamin and/or mineral deficiency, joint disease, rheumatoid disorders, and/or any other pathology. The medicinal agent may include any therapeutic contained in the World Health Organization's (WHO's) Essential Medicines List (WHO et al., 19th *WHO Model List of Essential Medicines* (April 2015), 19th edition. 2015, pp. 1-53, which is incorporated herein by reference in its entirety), the WHO'S Essential Medicines List for Children (WHO et al., 5th *WHO Model List of Essential Medicines for Children* (April 2015), 5th Edition. 2015) pp. 1-42, or the WHO's Model Formulary for Children (WHO et al., *WHO Model Formulary for Children,* 2010, pp. 1-528, incorporated herein by reference in its entirety), and additionally substances like prebiotics, probiotics, milk constituents or proteins, supplemental formula, vitamins, macronutrients, micronutrients, and a host of other compounds. For example, the agent 200 may include one or several of vaccines (e.g. rotavirus vaccines), antiretrovirals (e.g. Nevirapine or combination therapies like Lamivudine+Nevirapine+Stavudine), antimalarials (e.g. Artemisinin Combination Therapy), macronutrients, micronutrients, vitamins, or supplements (e.g. zinc, vitamin D), antibiotics (e.g., Amoxicillin, Azithromycin, Ciprofloxacin), probiotics (e.g. lactobacillus), prebiotics (e.g., lactoferrin, oligosaccharides), pain relievers (e.g. NSAIDS, opioids), antiparasitics (e.g. Albendazole, Praziquantel), antifungals (e.g. Fluconazole), antivirals (e.g. Aciclovir), antiprotazoals (e.g., Metronidazole), compounds correcting water, electrolyte, and acid-base disturbances (e.g. oral rehydration salts), gastrointestinal medicines, acid reflux medications, traditional or plant-based therapeutics, and/or any other therapeutic. The medicinal agent may also include substances meant to provide a benefit to the wearer of the device, such as ointments or creams.

As used herein, the term "delivery vehicle" with reference to the medicinal agent can include any structure or substance that carries the medicinal agent and can be positioned within the delivery device chamber for eventual mixing with the breast milk and delivery to the child. Examples of delivery vehicles for use with the present technology include one or more of the following: fabrics or fibers impregnated with the agent, tablets, micro-tablets, crushed tablets, or other powders, capsules containing a gel, liquid, powder (micro- or nano-) or other substance to be released, a gel, paste, syrup or other semi-solid, a liquid (e.g., suspensions, solutions, sprays, etc.), and/or other suitable delivery vehicles. In some embodiments, the delivery vehicle can be chemically or physically treated in order to aid dissolution. For example, a capsule can be lyophilized, freeze-dried, or vacuum dried, causing it to be more brittle and dissolve more quickly in the breast milk.

Selected Embodiments of Delivery Devices and Methods of Use

Figure 1A:
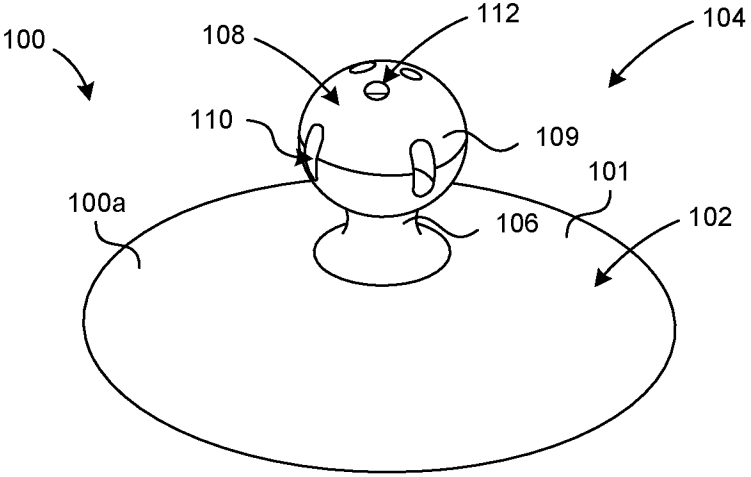
FIG. 1A is a perspective view of a delivery device configured in accordance with an embodiment of the present technology.
Figure 1C:
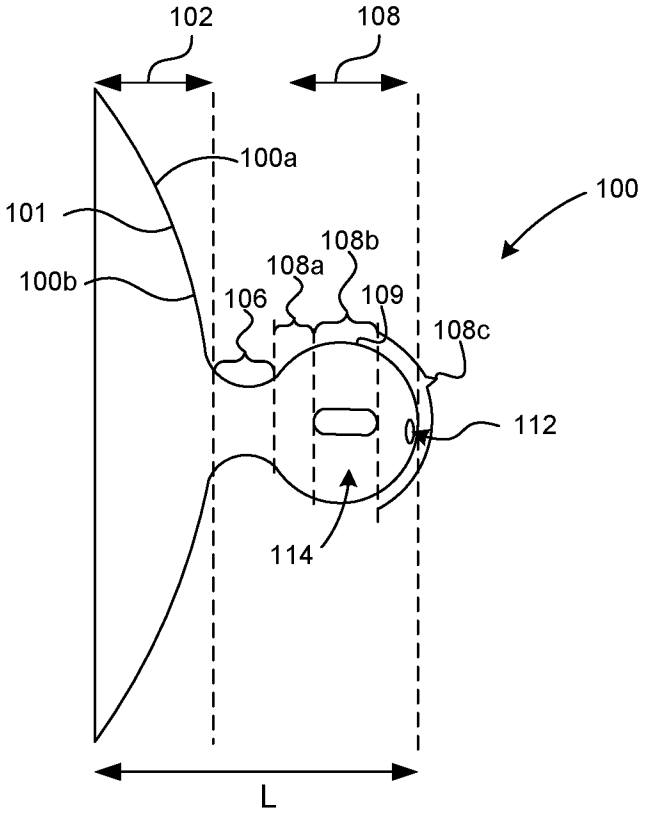
FIG. 1C is a cross-sectional side view of the delivery device shown in FIGS. 1A and 1B.

FIG. 1A is a perspective view of a delivery device 100 (also referred to herein as "device 100") configured in accordance with the present technology. FIGS. 1B and 1C are cross-sectional perspective and side views, respectively, of the delivery device 100 shown in FIG. 1A. Referring to FIGS. 1A-1C together, the delivery device 100 includes a nipple portion 102 configured to be engaged by a suckling child, and a breast portion 104 extending outwardly away from a proximal region of the nipple portion 102. The breast portion 104 has a curved shape and is configured to rest against the breast of a nursing female. For example, the breast portion 104 has a first surface 100*a* configured to face away from the breast during breastfeeding, and an interior surface 100*b* (not visible in FIG. 1A) configured to contact the breast during breastfeeding. The nipple portion 102 includes a neck region 106 extending distally from the breast portion 102, and a bulbous region 108 extending distally from the neck region 106. In the embodiment shown in FIGS. 1A-1C, the breast portion 104 and the nipple portion 102 are integral with one another such that the breast portion 102 is continuous with the neck region 106 of the nipple portion 104. In other embodiments, the breast portion 104 and the nipple portion 102 can be separate components that are configured to be permanently or releasably coupled to one another.

The bulbous region 108 of the nipple portion 102 can have a ball-shaped or otherwise rounded sidewall 109 that surrounds an inner chamber 110 configured to support and/or receive a medicinal agent and/or associated delivery vehicle for delivery to a breastfeeding child. The sidewall can have a distal zone 108*c*, an intermediate zone 10*b*, and a proximal zone 108*a* (labeled in FIG. 1C only). The rounded sidewall 109 may include a plurality of openings through which a fluid (such as breast milk) can be delivered from the breast of the female to the mouth of the child. For example, in the embodiment shown in FIGS. 1A-1C, the sidewall 109 has a plurality of distal openings 112 at the distal zone 108*c* and a plurality of lateral openings 110 (referred to collectively as "openings 111") at the intermediate zone 108*b*. The distal openings 112 may be generally circular and spaced apart at an end portion of the distal zone 108*c* of the bulbous region 108, and the lateral openings 110 may have an elongated shape and may be spaced apart about the circumference of the bulbous region 108 at the intermediate zone 108*b* of the bulbous region 108.

In other embodiments, the openings 111 can have other suitable arrangements, distributions, and/or shapes (e.g., oval, square, triangle, star-shaped, elongated etc.). For example, although the embodiment shown in FIGS. 1A-1C includes three distal openings 110, in other embodiments the bulbous region 108 may have more or fewer distal openings 110 (e.g., one, two, four, five, ten, twenty, etc.). Likewise, although the embodiment shown in FIGS. 1A-1C includes four lateral openings 112, in other embodiments the bulbous region 108 may have more or fewer lateral openings 112 (e.g., one, two, four, five, ten, twenty, etc.). In some embodiments, the distal openings 112 and the lateral openings 110 have the same shape. The device 100 may have openings at one or more of the distal zone 108 *c*, the intermediate zone 108 *b*, and the proximal zone 108 *a*. In some embodiments, one or more openings may spa n one or more of the distal zone 108 *c*, the intermediate zone 108 *b*, and the proximal zone 108 *a*. Moreover, in some embodiments the diameter of the openings 108 can be greater than or equal to about 2 mm. This sizing allows for the agent and/or delivery vehicle to pass through the nipple portion 104 without clogging. For example, as shown in FIG. 1C, the openings 111 are open in the absence of suction forces and mechanical forces from a breastfeeding child. The size and shape of the openings 111 can further ensure that at least some of the openings 111 are open when the suction forces and mechanical forces are exhibited by the child during breastfeeding to ensure a constant fluid path through the nipple portion 104 to inhibit clogging.

Referring still to FIGS. 1A-1C, the neck region 106 has a cross-sectional area that is less than the cross-sectional area of the bulbous region 104. The cross-sectional area of the neck region 106 can be configured to fit snugly against the nipple (see FIG. 3) and thus seal against the nipple to reduce or prevent breast milk (or other fluid) from leaking out of the chamber 114. The delivery device 100 and/or the nipple portion 104 can be made of a compliant and/or flexible material that expands and contracts to accommodate of variety of nipple shapes and sizes. Moreover, the delivery device 100 and/or nipple portion 104 can be made of an elastic material such that it may stretch in response to the suction forces exhibited by the child during breastfeeding. In some embodiments, all or a portion of the internal and/or external surface of the delivery device 100 may be textured. For example, in some embodiments all or a portion of the internal and/or external surfaces may include one or more bumps, ridges, pits, planes, and/or other suitable surface features. Such embodiments may be beneficial for imitating the natural texturing of the skin and/or nipple.

The sidewall 101 of the delivery device 100 shown in FIGS. 1A-1C has a generally constant thickness (FIG. 3B) along the length L (FIG. 1C) of the device 100. In other embodiments, the sidewall 101 may have a thickness t that varies along the length L of the device 100. In some embodiments, the thickness t of the sidewall along the nipple portion 104 is less than the thickness t of the sidewall 101 along the breast portion 102. For example, in some embodiments the thickness t along the sidewall of the breast portion 102 is two to five times greater than the thickness t along the sidewall of the nipple portion 104. In such embodiments, the thinness of the nipple portion 104 facilitates force transfer and a normal mouth-feel in the oral cavity, and the thickness of the breast portion 102 gives the device 100 structural integrity for anchoring and/or stabilizing the device 100 relative to the female's breast during breastfeeding. In other embodiments, the thickness t of the sidewall along the breast portion 102 is less than the thickness t of the sidewall 101 along the nipple portion 104. For example, in some embodiments the thickness t along the sidewall of the nipple portion 104 is two to five times greater than the thickness t along the sidewall of the breast portion 102. In the foregoing embodiment and any embodiment having a thin breast portion 102 to best approximate a natural breastfeeding experience for both the mother and the child. In some embodiments, the thickness of the sidewall 101 is less than or equal to about 1 mm. In certain embodiments, the thickness of the sidewall 101 is less than or equal to about 0.3 mm or less in thickness.

Figure 2B:
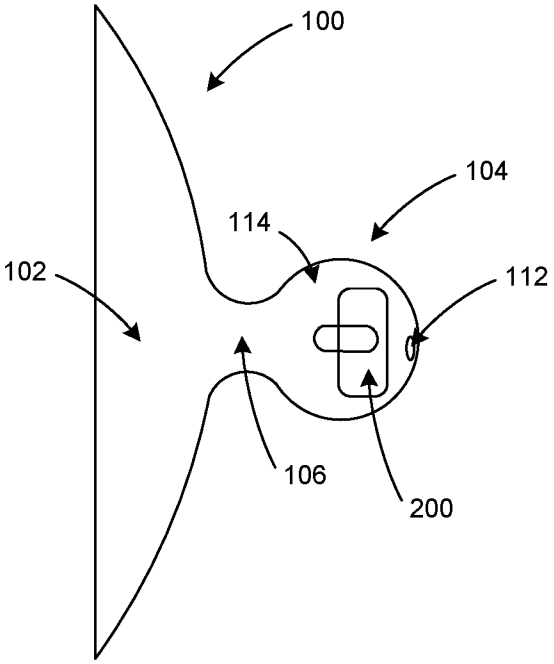
FIGS. 2A and 2B are cross-sectional perspective and side views, respectively, of the delivery device of FIGS. 1A-1C, shown with a medicinal agent positioned within the interior region of the nipple portion.
Figure 2A:
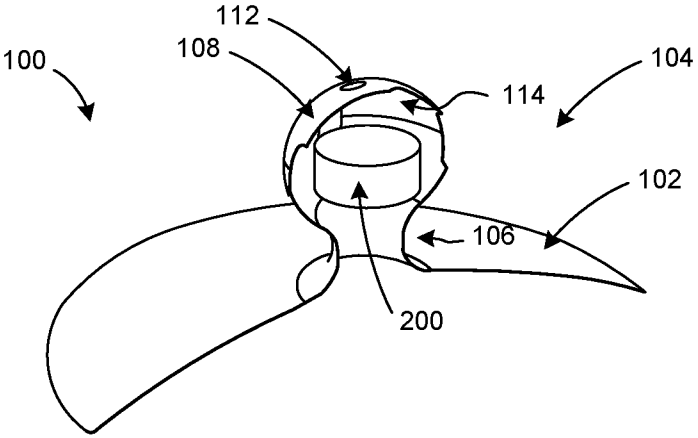
Figure 3B:
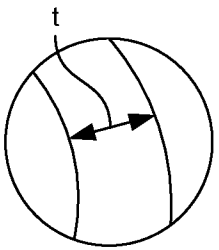
FIG. 3B is an enlarged view of a portion of the delivery device shown in FIG. 3A.
Figure 3A:
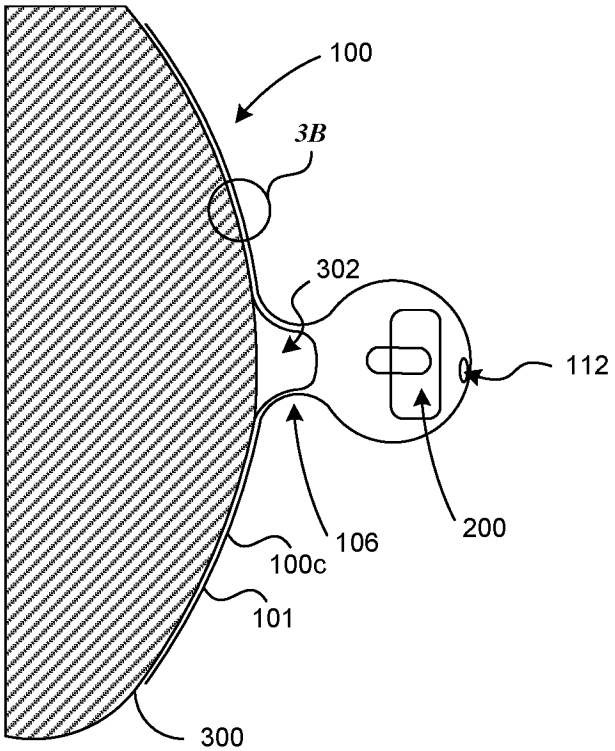
FIG. 3A is a schematic cross-sectional view of the delivery device of FIGS. 1A-2B with a medicinal agent therein and positioned on a breast.

FIGS. 2A and 2B are cross-sectional perspective and side views, respectively, of an agent 200 positioned within the chamber 114 of the nipple portion 104. FIG. 3 is a schematic side view showing the delivery device 100 positioned against a breast 300 with the nipple 302 positioned within the neck region 106.

The novel geometry and opening distribution of the delivery device 100 interact with the agent and/or delivery vehicle as the child is breastfeeding to facilitate fluid flow and, if applicable, agent or delivery vehicle breakdown. Through extensive testing of prototypes with a sophisticated breastfeeding simulation apparatus at the University of Cambridge, UK, we confirmed that the spacing, orientation, size, and/or number of openings 108 greatly affects how breast milk flows through the delivery device 100, as well as how the agent and/or delivery vehicle sits within inner chamber 110 relative to the openings 108. The positioning of the agent and/or delivery vehicle relative to the flow of breast milk and the openings 108 greatly affects efficiency of agent delivery to the child (measured both by total concentration of the agent delivered to the child and amount of agent/second delivered to the child).

Figure 4A:
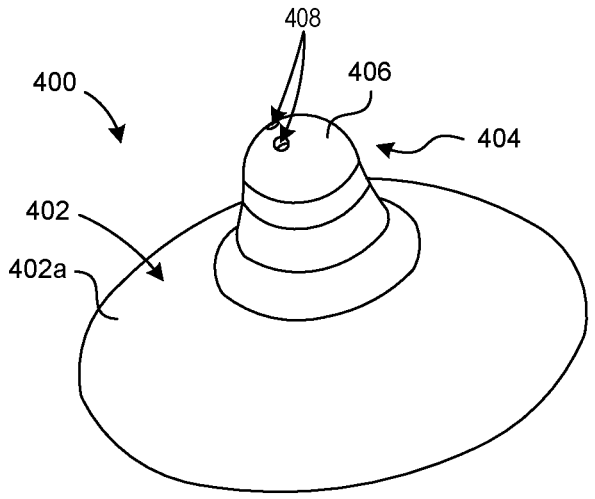
FIG. 4A is a perspective view of a delivery device configured in accordance with an embodiment of the present technology.
Figure 4B:
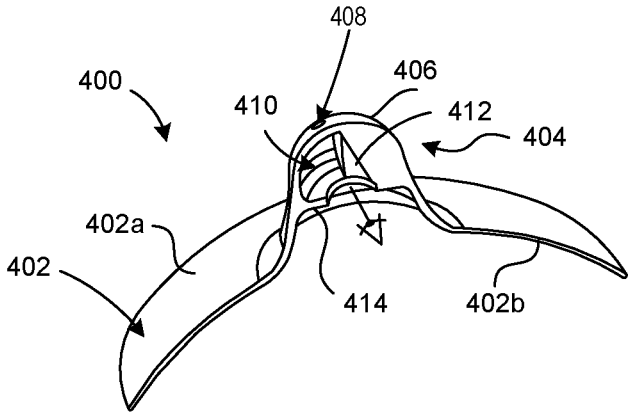
FIG. 4B is a cross-sectional view of the delivery device shown in FIG. 1A.
Figure 4C:
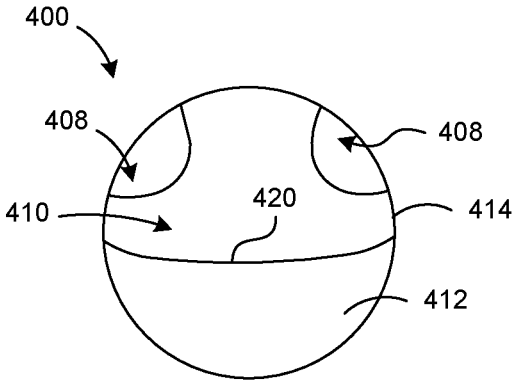
FIG. 4C is a view of the delivery device shown in FIG. 4A from the perspective shown by the icon in FIG. 4B. Although

FIGS. 4A and 4B are perspective and cross-sectional views, respectively, of a delivery device 400 configured in accordance with the present technology. As shown in FIGS. 4A and 4B, the delivery device 400 has an exterior surface 400*a* and an interior surface 400*b* (only visible in FIG. 4B). The device 400 further includes a nipple portion 402 configured to be engaged by a suckling child, and a breast portion 404 extending outwardly away from a proximal region of the nipple portion 402 and configured to rest against the breast of a nursing female. The nipple portion 402 includes a distal surface 406 having one or more openings 408 through which a fluid (such as breast milk) can be delivered from the breast to the mouth of the child. Although the embodiment shown in FIGS. 4A and 4B includes an annular lip 414, in other embodiments the delivery device 400 does not include an annular lip.

As best shown in FIG. 4B, the nipple portion 402 defines an inner chamber 410 configured to support and/or receive an agent (and/or delivery vehicle (described infra)) that is therapeutic and/or a dietary supplement and breast milk. The delivery device 400 includes a shelf 412 extending across a portion of the inner chamber 410. The shelf 412 includes a curved, upwardly facing surface configured to support the agent and/or delivery vehicle before, during, and/or after the child engages the nipple portion 404 and causes the breast milk to flow around and/or through the agent and/or delivery vehicle. Although the shelf 412 shown in FIG. 4B has a generally smooth, curved surface, in other embodiments the shelf 412 can be generally flat and/or have a textured surface and/or include one or more protrusions. In other embodiments, the shelf 412 can have other suitable shapes, sizes, and/or configurations.

In those embodiments employing a dissolvable or disintegrating agent and/or delivery vehicle, the inner chamber 410 geometry defined by the inner chamber walls and shelf 412 facilitates the dissolving or disintegration of the agent and/or delivery vehicle into the fluid flow of the breast milk by yielding dynamics which are not conducive to pooling. In particular, the shelf 412 and/or inner chamber walls induces a smoother and more linear flow of breast milk. In such embodiments, the shelf 412 prevents and/or otherwise inhibits the disintegrated tablet from collecting in the bottom of the inner chamber 410. The shelf 412 holds the agent and/or delivery vehicle directly in the flow of the breast milk instead of allowing the tablet to settle at the bottom of the inner chamber 410.

As shown in FIGS. 4A and 4B, the distal surface 406 of the nipple portion 402 has two openings 408 placed at forward-most curvature of the distal surface 406 that additionally facilitates the interaction of breast milk with the agent and/or delivery vehicle before exiting the nipple portion 404, thereby increasing the volume of agent and/or delivery vehicle delivered to the child's mouth per second. In other embodiments, however, the distal surface 406 can include more or fewer than two openings 408 and/or the openings 408 can be positioned at or along the distal surface 406 in different locations.

The diameter of the openings 408 can be greater than or equal to about 2 mm. This sizing allows for the agent and/or delivery vehicle to pass through the nipple portion 404 without clogging.

As mentioned above, the positioning of the agent and/or delivery vehicle relative to the flow of breast milk and the openings 408 greatly affects efficiency of agent delivery to the child (measured both by total concentration of the agent delivered to the child and amount of agent/second delivered to the child). For example, without the shelf 412 of the present technology, dissolvable and/or disintegrating agents and/or delivery vehicles may pool at the bottom of the inner chamber—below the openings 408—rather than pass through to the child as intended.

Figure 5A:
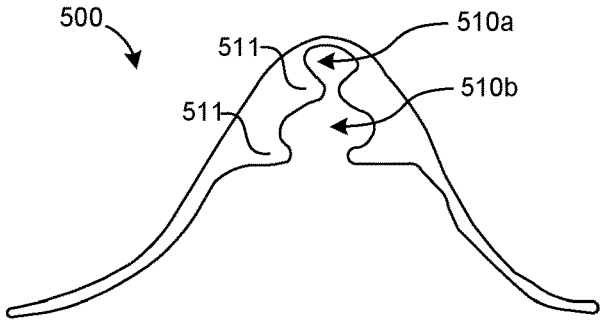
FIGS. 5A-5G are cross-sectional side views of different delivery device embodiments in accordance with the present technology.
Figure 5B:
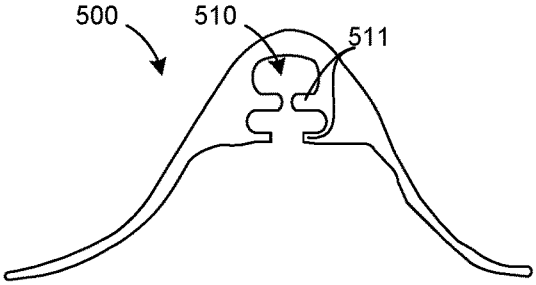
Figure 5C:
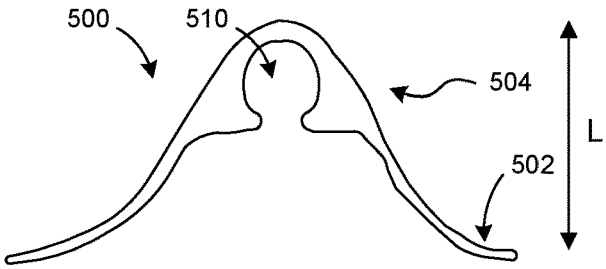
Figure 5D:
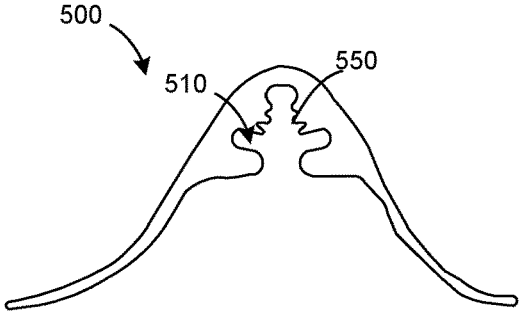
Figure 5E:
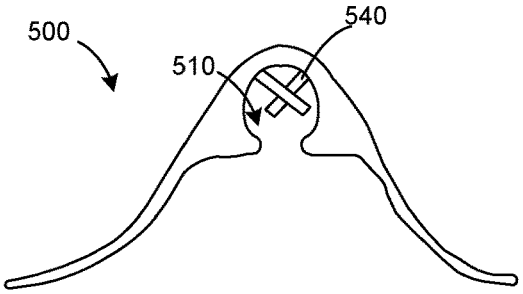
Figure 5F:
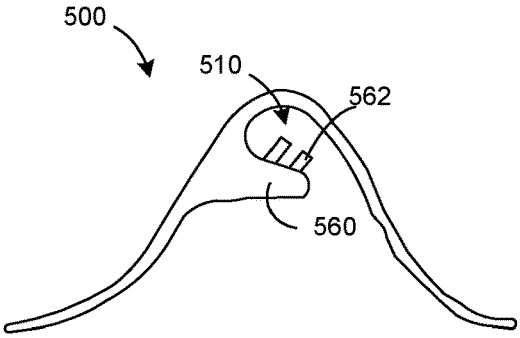
Figure 5G:
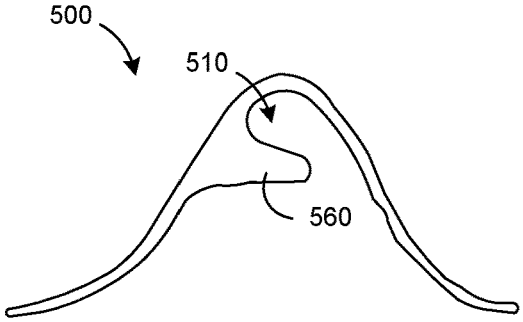

FIGS. 5A-5G are schematic cross-sectional side views of delivery devices 500 having different internal geometries and/or structural elements. As discussed above, such the internal geometry of the delivery device 500 greatly determines the positioning of the agent and/or delivery vehicle relative to the flow of breast milk, and thus the efficiency of delivery of the medicinal agent to the child during breastfeeding and/or the dosage delivered to the child during breastfeeding. For example, the delivery devices 500 of FIGS. 5A and 5B include multiple annular flanges 511 that project from the sidewall into the chamber, thus separating the internal chamber into a first chamber 510*a* and a second chamber 510*b* that are fluidly coupled to one another. The flanges 511 thus provide an undulating shape to the internal surface of the nipple portion. The agent may be positioned between the flanges 511. As shown in FIG. 5A, the annular flanges 511 can be rounded. As shown in FIG. 5B, the annular flanges 511 can have a more rectangular shape. In some embodiments, the delivery device 500 can include more or less than two flanges 511, and/or the internal chamber may be divided into more than two sub-chambers. As shown in FIG. 5C, the chamber can have an elongated, oval shape. Also as shown in FIG. 5C, the thickness t of the sidewall at the nipple portion 502 can be greater than the thickness of the sidewall at the breast portion 502, and the thickness t of the sidewall at the nipple portion 502 can change along the length L of the nipple portion 502. As shown in FIG. 5D, one or more of the flanges can be textured or include undulations. As shown in FIG. 5E, the inner surface of the bulbous portion may include one or more stabilizing member protruding into the interior of the chamber 510. As shown in FIGS. 5F and 5G, one or more of the flanges may not be annular and instead may extend along only a portion of the inner circumference of the bulbous region. Also, the flanges may have an angled surface, and may include one or more projections (FIG. 5G). Any combination of the features described with reference to FIGS. 5A-5G can be used with any of the delivery device embodiments described herein.

Additional Embodiments of Agents

In some embodiments the medicinal agent can be dissolvable. The dissolvable agent can be any agent that can provide a therapeutic benefit to the child, such as pharmaceutical drugs, prodrugs, vitamins, additives, etc. Agents that can be delivered through the delivery device 100 include, for example: the World Health Organization (WHO) Essential Medicines List 2015 (which can be found at, for example, http://www.whaint/selection medicines/committees/expert/20/EML_2015 FINAL_amended_AUG2015.pdf?ua=1, and includes the WHO Essential Medicines List for Children 2015 and the WHO Model Formulary for Children, (both of which can be found at http://www.who.int/medicines/publications/essentialmedicines/EMLc_2015_FINAL_amended_AUG2015.pdf?ua=1 and http://apps.who.int/medicinedocs/documents/s 17151 e/s17151 e. pdf, respectively)), vaccines (e.g., for example, rotavirus vaccines), antiretrovirals (e.g. Nevirapine or combination therapies like Lamivudine+Nevirapine+Stavudine), antimalarials (e.g., Artemisinin Combination Therapy (ACT)), macronutrients, micronutrients, vitamins, or supplements (e.g., zinc, vitamin D, etc.), antibiotics (e.g., Amoxycillin, Azithromycin, Ciprofloxacin, etc.), probiotics (e.g., lactobacillus, etc.), pain relievers (e.g., NSAIDs (such as ibuprofen), opioids, etc.), antiparasitic drugs (e.g., Albendazole, Praziquantel, etc.), antifungals (e.g., Fluconazole, etc.), antivirals (e.g., Aciclovir, etc.), antiprotozoal therapies (e.g., Metronidazole, etc.), compounds correcting water, electrolyte, and acid-base disturbances (e.g., oral rehydration salts, etc.), gastrointestinal medicines, acid reflux medications, traditional or plant-based therapeutics, and/or other suitable agents.

In some embodiments, the agent can be incorporated within a delivery vehicle, as described above.

In some embodiments, the delivery system and/or delivery vehicle can include a means for changing the eventual release behavior of the agent into the breast milk, such as via one or more chemical compounds or excipients. The delivery system and/or delivery vehicle can also include a formulation to influence the viscosity of the local fluid environment. For example, the delivery vehicle can be or contain a gel containing an edible polymer, which would affect the viscosity of the mixture. In some embodiments, the delivery vehicle may include a chemical treatment of, or within, the delivery vehicle that affects the agent's release rate. Such chemical treatments may affect chemical changes, such as hydrophobicity changes, and/or physical changes such as structural changes, porosity changes, brittleness changes, hardness changes and/or others.

In several embodiments, the delivery system can include excipients configured to improve bioavailability or solubility, such as powdered milk components to improve taste or bioavailability. The delivery system and/or delivery vehicle can also include excipients which help control release of the agent to targeted areas such as that of the digestive system, oral cavity, or other areas; and/or excipients which prevent curdling and agglomeration of milk from the presence of other excipients. In some embodiments, the delivery system and/or delivery vehicle can also include agents and particulate properties to facilitate taste masking, and taste or texture protection. For example, the agent can be microencapsulated to maintain the original taste of the breast milk, and particulate properties can be chosen to preserve the mouth-feel of breast milk.

Advantages

The delivery devices disclosed herein provide several advantages over commonly available methods of administration.

The device 100 is disposable, which allows for a very thin material thickness throughout, and ensures hygienic delivery as it is not reused. Such a feature is beneficial, as hygienic and accurate delivery of agents was of particular concern to mothers and other stakeholders (clinicians, hospital staff, public health workers, etc.) in acceptability studies conducted by the inventors. The features of the delivery devices described herein, including the fact that when used the milk/agent mixture is deposited at the back of the child's mouth, ensure that an accurate, full, dose of the agent is delivered. In interviews with mothers using conventional nipple shields, many observed that without a feature like the sealing region 104 in the device 100, milk would leak out of the nipple shield. Various embodiments of the device as described in the claims, including things like the device being able to come in a variety of colors or be color-coded, were positively received by mothers in our studies.

The delivery devices and methods of the present technology provide the following additional advantages: (a) making the process of administration more familiar and organic for a mother and infant, the ability to deliver dry formulations without mixing with water, avoiding the use of potentially non-potable water and the cold chain and/or refrigerated storage requirements of some liquid or syrup formulations, (b) the ability to easily control dosage, (c) the ability to ensure and promote proper hygiene, (d) the reduction in the number and complexity of tasks that mothers have to perform in order to administer lifesaving therapeutics, (e) increased bioavailability of intended therapeutics through using milk as a delivery agent, increased milk transfer through the use of a breastfeeding aid for premature infants, and (f) the ability to follow breastfeeding guidelines while administering therapeutic supplementation for undernourished, sick, or premature infants.

By realizing even some of these advantages, the present technologies could be transformative for the lives of mothers and infants and for the field of pediatric therapeutic delivery, improving the health outcomes of millions of infants globally by addressing the identified need for new low cost devices, systems, and methods for delivering therapeutics to infants. As a specific example, recent studies have shown that giving antiretroviral medications (ARVs) to infants reduces the risk of HIV transmission from mother to child. Accordingly, the most promising strategy to prevent HIV transmission through breast milk involves prophylactic treatment of breastfeeding infants with ARVs. However, the preparation of the liquid and/or syrup formulations involved in this ARV treatment for infants can be complex and time consuming, and moreover these formulations may reduce the stability of the medication and require refrigeration. The present technologies reduce and/or eliminate these issues. As another specific example, the WHO has argued that a lack of infant formulations of most antimalarial drugs necessitates division of adult tablets, which can lead to inaccurate dosing. Using the present technologies in such scenarios could address this problem.

EXAMPLES

The following examples are illustrative of several embodiments of the present technology:

1. A device for delivering an agent orally to a breastfeeding child, the device comprising:

(a.) a broad breast portion configured to be positioned adjacent to and/or in contact with the breast during breastfeeding; and (b.) a nipple portion extending from the first portion, the second portion including a bulbous region and a narrowed neck region, wherein the neck region is coupled to and extends from the breast portion and the bulbous region is coupled to and extends from the neck region, wherein:

(i.) the bulbous region has a sidewall that surrounds a chamber configured to house the agent during breastfeeding, the bulbous region having a first cross-sectional area; and (ii.) the neck region has a second cross-sectional area at least great enough to surround and engage a circumference of the nipple but less than the first cross-sectional area, wherein the neck region includes a sealing member configured to surround and engage a nipple of a female, wherein, when the device is positioned on the breast and the child is breastfeeding, milk flows from the nipple through the agent region into the mouth of the child, and the device is configured so that the nipple extends through the sealing region into the agent region and the portion of the device at the sealing region contacts the nipple, thereby reducing a proximal flow of breast milk and/or the agent through the sealing region to the first portion.

2. A device according to example 1, wherein the device and the agent are separate components.

3. A device according to example 1 or example 2, wherein the cavity is sized to receive the agent therein.

4. A device according to example 1, wherein the nipple portion includes one or more stabilizing members protruding from an inner surface of the sidewall of the nipple portion to secure the agent within the cavity.

5. A device according to example 4, wherein the second cross-sectional area relative to the size of the agent is such that the agent is housed securely in the cavity the.

6. A device according to example 4, wherein an inner surface of the nipple portion is configured to adhere to the agent such that the agent is secured within the nipple portion.

7. A device according to example 1, wherein the dosage form of the agent includes one or more of fabrics; textiles; or fibers impregnated with the agent; tablets; micro-tablets; crushed tablets or other powders; capsules containing a gel, liquids, powders, micro-powders, nano-powders, gases or other substances to be released; gels; pastes; syrups or other semi-solids; solids; viscous or non-viscous liquids (e.g. suspensions, solutions, sprays), gases; drug delivery vehicles made up of materials such as responsive polymers, containing an agent; microneedles; patches; or other transdermal forms; or any other form.

8. A device according to example 1, wherein the device and/or the dosage form of the agent includes a means for changing the release behavior of the agent into the breast milk.

9. A device according to example 8, wherein the release behavior of the agent into breast milk is changed by the presence of one or more chemical compounds or excipients.

10. A device according to example 8, wherein the release behavior of the agent into breast milk is changed by the inclusion of a formulation to influence the viscosity of the local fluid environment such as the inclusion of a gel containing an edible polymer affecting the viscosity of the mixture as the dosage form.

11. A device according to example 8, wherein the release behavior of the agent into breast milk is changed by a chemical treatment of, or within, the dosage form which induces hydrophobicity changes.

12. A device according to example 8, wherein the release behavior of the agent into the breast milk is changed by the dosage form having been processed under a set of manufacturing conditions which induces the dosage form to dissolve, disintegrate, release the agent, or a combination thereof, more quickly.

13. A device according to example 12, wherein the dosage form is lyophilized, freeze dried or vacuum dried.

14. A device according to example 12, wherein the dosage form is chemically treated.

15. A device according to example 12, wherein the dosage form is perforated.

16. A device according to example 12, wherein the eventual release behavior of the agent into breast milk is changed by the dosage form having been made brittle.

17. A device according to example 16, wherein the dosage form has been lyophilized or freeze dried.

18. A device according to example 17, wherein the dosage form is a capsule.

19. A device according to example 17, wherein the dosage form is a tablet.

20. A device according to example 17, wherein the dosage form is a film.

21. A device according to example 12, wherein the dosage form comprising a tablet has been compressed at specific compression values to facilitate controlled agent release.

22. A device according to example 12, wherein the dosage form comprising a tablet has been treated at various humidity levels to facilitate controlled agent release.

23. A device according to example 12, wherein the dosage form comprising a tablet has been lyophilized.

24. A device according to example 1, wherein the dosage form of the agent includes excipients to improve bioavailability and/or solubility of the agent, or taste.

25. A device according to example 24, wherein the excipients include powdered milk components.

26. A device according to example 24, wherein the dosage form includes excipients to control the disintegration rate of the dosage form.

27. A device according to example 26, wherein the excipients include one or more disintegrants.

28. A device according to example 26, where in the particle size of the excipients is chosen to facilitate disintegration of the dosage form.

29. A device according to example 24, wherein the dosage form includes excipients to control release of the therapeutic or therapeutics in targeted areas of the digestive system.

30. A device according to example 29, wherein the excipients are pH responsive.

31. A device according to example 24, wherein the dosage form includes excipients to prevent or reduce curdling and/or agglomeration of milk from the presence of other excipients.

32. A device according to example 24, wherein the dosage form includes substances and/or utilizes particulate properties to facilitate taste masking, and taste and/or texture protection.

33. A device according to example 32, wherein the dosage form is microencapsulated to preserve taste and/or mouthfeel of breast milk.

34. A device according to example 1, wherein the agent includes a therapeutic or therapeutics.

35. A device according to example 34, wherein the therapeutic is efficacious in the treatment and/or prevention of generalized or localized pain, allergic reactions, seizure, infection (e.g. parasitic, bacterial, leprotic, tuberculotic, fungal, viral, retroviral, hepatic, protozoal, or of another sort), migraine, immune system disorders, imbalances, or autoimmune disease, hormonal imbalances, endocrine disorders, anaemia, haemoglobinopathies, hypertension, lipid disorders, dermatological disease (e.g. fungal, infective, pruritic, or scabicidal), ophthalmic disease, sepsis, gastrointestinal disease (e.g. ulcers, vomiting, nausea, constipation), diarrhea, dehydration, poisoning, venom toxicity, inflammation, psychosis, mood disorders, depression, psychiatric disorders, asthma, electrolyte and acid-base disturbances, vitamin and/or mineral deficiency, joint disease, rheumatoid disorders, and/or any other pathology.

36. A device according to example 33, wherein the therapeutic includes one or several of vaccines (e.g. rotavirus vaccines), antiretrovirals (e.g. Nevirapine or combination therapies like Lamivudine+Nevirapine+Stavudine), antimalarials (e.g. Artemisinin Combination Therapy), macronutrients, micronutrients, vitamins, or supplements (e.g. zinc, vitamin D), antibiotics (e.g. Amoxicillin, Azithromycin, Ciprofloxacin), probiotics (e.g. lactobacillus), prebiotics (e.g. lactoferrin, oligosaccharides), pain relievers (e.g. NSAIDS, opioids), antiparasitics (e.g. Albendazole, Praziquantel), antifungals (e.g. Fluconazole), antivirals (e.g. Aciclovir), antiprotazoals (e.g. Metronidazole), compounds correcting water, electrolyte, and acid-base disturbances (e.g. oral rehydration salts), gastrointestinal medicines, acid reflux medications, traditional or plant-based therapeutics, and/or any other therapeutic.

37. A device according to example 1, wherein the device incorporates a therapeutic or therapeutics for the mother.

38. A device according to example 37, wherein the therapeutic or therapeutics for the mother are contained in the agent region.

39. A device according to example 37, wherein the device includes a therapeutic cream, ointment, or other substance on the inside surface of the device intended for the mother.

40. A device according to example 39, wherein the therapeutic cream, ointment, or other substance is intended to treat mastitis or discomfort in the nipple region.

41. A device according to example 37, wherein the inner surface of the device incorporates microneedles to deliver a therapeutic or therapeutics to the mother.

42. A device according to example 37, wherein the therapeutic or therapeutics for the mother are intended to promote lactoferrin and/or milk production.

43. A device according to example 1, wherein the agent region includes openings of a size, shape, and configuration which are conducive to the flow of breast milk and/or a breast milk/agent mixture through them.

44. A device according to example 43, wherein the openings are configured normally to the surface of the agent region at the distal tip of the agent region.

45. A device according to example 43, wherein the openings are configured normally to the surface of the agent region laterally around the agent region and/or at the distal tip of the agent region.

46. A device according to example 43, wherein the shape and/or size of the openings changes when the device is positioned on the breast and the child is breastfeeding in order to facilitate the flow of breast milk and/or a breast milk/agent mixture.

47. A device according to example 43, wherein the openings are configured at non-normal angles to the surface of the agent region.

48. A device according to example 47, wherein the openings are configured at angles parallel with the tool pull direction if the device is manufactured with an injection molding, dip-molding, casting, compression molding, extrusion molding, machining, 3D printing, or other method; or a combination thereof.

49. A device according to example 47, wherein the openings are configured to accommodate a variety of child feeding angles.

50. A device according to example 43, wherein the openings are circular in shape.

51. A device according to example 43, wherein the openings are elliptical or rectangular in shape.

52. A device according to example 43, wherein the openings are of multiple shapes.

53. A device according to example 52, wherein the openings at the distal tip of the agent region are circular, while the openings at the sides of the agent region are elliptical and/or rectangular.

54. A device according to example 1, wherein no agent is housed in agent region.

55. A device according to example 54, wherein an agent is coated on the external surface of the device.

56. A device according to example 54, wherein an agent is coated on the internal surface of the device.

57. A device according to example 54, wherein an agent is impregnated into the device and is consumed by the child in the process of breastfeeding.

58. A device according to example 1, wherein an edible substance is applied to the outside of the device.

59. A device according to example 57, wherein the edible substance is sweet and/or attractive to a breastfeeding child.

60. A device according to example 1, wherein an agent is delivered to the child transdermally by the mouth or face through skin-to-skin contact.

61. A device according to example 1, wherein the device and/or the agent is/are of a variety of colors.

62. A device according to example 61, wherein the colors of the device and/or the agent are chosen to match the skin tone(s) of the user(s).

63. A device according to example 61, wherein the colors of the device and/or the agent are chosen to correspond with different agents.

64. A device according to example 61, wherein the colors of the device and/or the agent are chosen to correspond with different ages of breastfeeding children.

65. A device according to example 1, wherein the device is of different sizes to accommodate different anatomies.

66. A device according to example 1, wherein the shape of a horizontal cross section of the first portion of the device is triangular with rounded corners.

67. A device according to example 1, wherein the shape of a horizontal cross section of the first portion of the device is in the shape of a pinched ellipse.

68. A device according to example 1, wherein the shape of a horizontal cross section of the first portion of the device is roughly circular.

69. A device according to example 1, wherein the material thickness of the second portion is thinner than the material thickness of the first portion.

70. A device according to example 69, wherein the material thinness of the second portion facilitates force transfer and a normal mouth-feel in the oral cavity, and the thickness of the first portion gives the device structural integrity.

71. A device according to example 1 wherein the first and second portion are thin to facilitate minimization of the device's effects on breastfeeding.

72. A device according to example 71, wherein the thickness of the first and second portions of the device are less than 1 mm.

73. A device according to example 72, wherein the first and second portion are 0.3 mm or less in thickness.

74. A device according to example 1, wherein the surface of the device is textured.

75. A device according to example 74, wherein the external surface of the device is textured like that of a woman's breast.

76. A device according to example 74, wherein features are added to the external surface of the device including one or more of bumps, ridges, pits, or any other features.

77. A device according to example 76, wherein the features increase the comfort of using the device for the child.

78. A device according to 76, wherein the features facilitate the latching-on of the child.

79. A device according to example 74, wherein the internal surface of the device is textured like that of a child's oral cavity.

80. A device according to example 74, wherein features are added to the internal surface of the device including one or more of bumps, ridges, pits, or any other features.

81. A device according to example 80, wherein the features increase the comfort of using the device for the mother.

82. A device according to example 80, wherein the features facilitate the secure placement of the device on the mother.

83. A device, according to example 1, wherein the device includes a substance on the internal surface of the device.

84. A device according to 83, wherein the substance facilitates the secure placement of the device on the mother.

85. A device according to example 84, wherein the substance is a non-toxic adhesive.

86. A device according to example 1, wherein the first portion incorporates holes.

87. A device according to example 86, wherein the holes facilitate greater skin-to-skin contact while breastfeeding.

88. A device according to example 1, wherein the ratio of the first cross-sectional area to the second cross-sectional area gets larger after the device is positioned for use.

89. A device according to example 1, wherein the device contains sensors.

90. A device according to example 89, wherein the sensors can determine forces and/or pressures during use.

91. A device according to example 90, wherein the sensors measure the child's oral vacuum during use.

92. A device according to example 90, wherein the sensors measure the pressure and/or force applied by the child's tongue during use.

93. A device according to example 89, wherein the sensors can determine feeding volumes.

94. A device according to example 93, wherein this determination is accomplished by measuring jaw movement.

95. A device according to example 93, wherein this determination is accomplished by measuring milk flow rates.

96. A device according to example 89, wherein the sensors measure indicators for health information about the mother and/or the child.

97. A device according to example 1, which is reusable.

98. A device according to example 1, which is self-sterilizing.

99. A device according to example 98, which includes a microbicidal coating.

100. A device according to example 98, which includes a photoactive coating.

101. A device according to example 1, wherein the device is difficult for a child to ingest or choke on.

102. A device according to example 1, wherein the device is not harmful if ingested.

103. A device according to example 102, wherein ingesting part and/or all of the device is intended to provide therapeutic benefit to the child.

104. A device according to example 1, wherein a visible part of the device changes in appearance once used and/or once a desired dosage of the agent is released.

105. A device according to example 104, wherein the device or the agent changes in color or appearance once used.

106. A device according to example 104, wherein a visible icon, text, or symbol on the device disappears or appears once used.

107. A device according to example 1, wherein part or all of the material of the device is biodegradable.

108. A device according to example 107, wherein the device material incorporates a biodegradable polymer.

109. A device according to example 108, wherein the device is made up of in whole or in part by poly(lactic-co-glycolic acid).

110. A device according to example 1, wherein part or all of the material of the device has a suitability for burning and/or recyclability.

111. A device according to example 110, wherein the material of the device is biodegradable, thermoresponsive, and/or able to be repurposed.

112. A device according to example 110, wherein the device degrades after being left on the ground in the open and/or in an anaerobic environment.

113. A device according to example 110, wherein the device degrades after being soaked in water.

114. A device according to example 1, wherein the device is disposable.

115. A device according to example 114, wherein the device is self-destroying or self-limiting after use.

116. A device according to example 115, wherein the device changes shape to prevent further reuse after use.

117. A device according to example 115, wherein the device loses structural integrity after use.

118. A device according to example 117, wherein the device incorporates milk, water or oil soluble compounds.

119. A device according to example 114, wherein the sensory and/or organoleptic experience for the child is changed after use to discourage reuse.

120. A device according to example 119, wherein the smell or taste of the device for the child is changed after use to discourage reuse.

121. A device according to example 114, wherein the device makes a sound when re-used.

122. A device according to example 121, wherein the sensory and/or organoleptic experience for the child is changed when reused, the sensory and/or organoleptic experience of the mother is changed, or both.

123. A device according to example 1, wherein the device is made up of biological material in whole or in part.

124. A device according to example 1, wherein the device is made up of a polymer, in whole or in part.

125. A device according to example 124, wherein the device is made up in whole or in part of silicone, low-density polyethylene, polypropylene, polystyrene, nylon, or other polymers which could have various chain lengths.

126. A device according to example 125, wherein the device is made of a combination of polymers.

127. A device according to example 125, wherein a portion or all of the device is made up of an emulsion of polymers, such as latex.

128. A device according to example 1, wherein the device is made in whole or in part by injection molding, dip-molding, casting, compression molding, extrusion molding, machining, 3D printing, or other methods; or a combination thereof.

129. A device according to example 1, wherein the agent region comprises three sub-regions:

a nipple cavity region;

a retention region; and an agent containment region,

130. A device according to example 129, wherein the nipple cavity region is proximal of the retention region which is proximal of the agent containment region.

131. A device according to example 129, wherein, when the device is positioned on the breast and the child is breastfeeding, the device is configured so that the nipple extends through the sealing region into the nipple cavity region and the portion of the device at the sealing region contacts the nipple, the nipple cavity region extends past the distal tip of the nipple, the retention region acts to secure the agent within the agent containment region, and milk flows from the nipple cavity region through the retention region to the agent containment region.

132. A device according to example 129, wherein the retention region has a cross-sectional area which is smaller than the cross-sectional area of the agent containment region and small enough to secure the agent within the agent containment region.

133. A device according to example 131, wherein the retention region includes a lip or annular ring.

134. A device according to example 131, wherein the retention region includes flaps.

135. A device according to example 131, wherein the agent containment region incorporates a shelf and/or other solid internal structures to facilitate particular agent and/or milk dynamics when used.

136. A device according to example 135, wherein the volume in the agent containment region is reduced to force the agent into the flow of milk and facilitate agent dissolution and/or wherein the solid internal structures secure the agent into a particular orientation within the agent containment region.

137. A device for delivering an agent orally to a user, the device comprising:

(a.) a first portion configured to be positioned adjacent to and/or in contact with a second device; and (b.) a second portion extending from the first portion, defining a cavity therein, and comprising two regions:

(i.) an agent region configured to house the agent, the agent region having a first cross-sectional area; and (ii.) a sealing region proximal of the agent region having a second cross-sectional area at least great enough to surround and engage a portion of the second device but less than the first cross-sectional area, wherein, when the device is positioned on the second device during use, the device is configured so that the second device attaches to the first device through the sealing region and/or the first portion in such a way to reduce a backwards flow of media to/from the second device should it be present and/or the agent through the sealing region to the first portion.

138. A device according to example 137, wherein said second device is a dropper.

139. A device according to example 137, wherein said second device is a baby bottle.

140. A device according to example 137, wherein said second device is a pacifier.

141. A device according to example 137, wherein said second device is a syringe.

142. A device according to example 137, wherein said second device is a cup.

143. A device according to example 137, wherein the device and the agent are readily separable.

144. A device according to example 137, wherein the agent is housed securely in the agent region.

145. A device according to example 137, wherein the media is breast milk, water, juice, nutritional drink, liquid therapeutic, or other liquid solution, in whole, in part, or in combination with the others.

146. A device according to example 137, wherein there is no media.

147. A device according to example 146, wherein the agent is housed securely in the agent region due to the size of the second cross-sectional area relative to the size of the agent.

148. A device according to example 146, wherein the agent is housed securely in the agent region due to adherence of the agent with the inner surface of the agent region.

149. A device according to example 137, wherein the agent includes a therapeutic or therapeutics.

150. A device according to example 149, wherein the dosage form of the therapeutic includes one or more of fabrics; textiles; or fibers impregnated with the agent; tablets; micro-tablets; crushed tablets or other powders; capsules containing a gel, liquids, powders, micro-powders, nano-powders, gases or other substances to be released; gels; pastes; syrups or other semi-solids; solids; viscous or non-viscous liquids (e.g. suspensions, solutions, sprays), gases; drug delivery vehicles made up of materials such as responsive polymers, containing an agent; microneedles; patches; or other transdermal forms; or any other form.

151. A device according to example 149, wherein the device and/or the dosage form includes a means for changing the eventual release behavior of the agent into the breast milk.

152. A device according to example 151, wherein the release behavior of the agent into media is changed by the presence of one or more chemical compounds or excipients.

153. A device according to 151, wherein the eventual release behavior of the agent into media is changed by the inclusion of a formulation to influence the viscosity of the local fluid environment such as the inclusion of a gel containing an edible polymer affecting the viscosity of the mixture as the dosage form.

154. A device according to example 151, wherein the eventual release behavior of the agent into media is changed by a chemical treatment of, or within, the dosage form which induces hydrophobicity changes.

155. A device according to example 151, wherein the eventual release behavior of the agent into the media is changed by the dosage form having been processed under a set of manufacturing conditions which induces the dosage form to dissolve, disintegrate, release the agent, or a combination thereof, more quickly.

156. A device according to example 155, wherein the dosage form is lyophilized, freeze dried or vacuum dried.

157. A device according to example 155, wherein the dosage form is chemically treated.

158. A device according to example 155, wherein the dosage form is perforated.

159. A device according to example 155, wherein the eventual release behavior of the agent into media is changed by the dosage form having been made brittle.

160. A device according to example 159, wherein the dosage form has been lyophilized or freeze dried.

161. A device according to example 160, wherein the dosage form is a capsule.

162. A device according to example 160, wherein the dosage form is a tablet.

163. A device according to example 160, wherein the dosage form is a film.

164. A device according to example 155, wherein the dosage form comprising a tablet has been compressed at specific compression values to facilitate controlled agent release.

165. A device according to example 155, wherein the dosage form comprising a tablet has been treated at various humidity levels to facilitate controlled agent release.

166. A device according to example 155, wherein the dosage form comprising a tablet has been lyophilized.

167. A device according to example 149, wherein the therapeutic is efficacious in the treatment and/or prevention of generalized or localized pain, allergic reactions, seizure, infection (e.g. parasitic, bacterial, leprotic, tuberculotic, fungal, viral, retroviral, hepatic, protozoal, or of another sort), migraine, immune system disorders, imbalances, or autoimmune disease, hormonal imbalances, endocrine disorders, anaemia, haemoglobinopathies, hypertension, lipid disorders, dermatological disease (e.g. fungal, infective, pruritic, or scabicidal), ophthalmic disease, sepsis, gastrointestinal disease (e.g. ulcers, vomiting, nausea, constipation), diarrhea, dehydration, poisoning, venom toxicity, inflammation, psychosis, mood disorders, depression, psychiatric disorders, asthma, electrolyte and acid-base disturbances, vitamin and/or mineral deficiency, joint disease, rheumatoid disorders, and/or any other pathology.

168. A device according to example 149, wherein the therapeutic includes one or several of vaccines (e.g. rotavirus vaccines), antiretrovirals (e.g. Nevirapine or combination therapies like Lamivudine+Nevirapine+Stavudine), antimalarials (e.g. Artemisinin Combination Therapy), macronutrients, micronutrients, vitamins, or supplements (e.g. zinc, vitamin D), antibiotics (e.g. Amoxicillin, Azithromycin, Ciprofloxacin), probiotics (e.g. lactobacillus), prebiotics (e.g. lactoferrin, oligosaccharides), pain relievers (e.g. NSAIDS, opioids), antiparasitics (e.g. Albendazole, Praziquantel), antifungals (e.g. Fluconazole), antivirals (e.g. Aciclovir), antiprotazoals (e.g. Metronidazole), compounds correcting water, electrolyte, and acid-base disturbances (e.g. oral rehydration salts), gastrointestinal medicines, acid reflux medications, traditional or plant-based therapeutics, and/or any other therapeutic.

169. A device according to example 149, wherein the dosage form includes excipients to improve bioavailability and/or solubility of the therapeutic or therapeutics, or taste.

170. A device according to example 169, wherein the excipients include powdered milk components.

171. A device according to example 149, wherein the dosage form includes excipients to control the disintegration rate, dissolution rate, or both of the dosage form.

172. A device according to example 171, wherein the excipients include one or more disintegrants.

173. A device according to example 171, where in the particle size of the excipients is chosen to facilitate disintegration of the dosage form.

174. A device according to example 149, wherein the dosage form includes excipients to control release of the therapeutic or therapeutics in targeted areas of the digestive system.

175. A device according to example 174, wherein the excipients are pH responsive.

176. A device according to example 149, wherein the dosage form includes excipients to prevent or reduce curdling and/or agglomeration of milk from the presence of other excipients.

177. A device according to example 149, wherein the dosage form includes substances and/or utilizes particulate properties to facilitate taste masking, and taste and/or texture protection.

178. A device according to example 177, wherein the dosage form is microencapsulated to preserve taste and/or mouthfeel of breast milk.

179. A device according to example 1, wherein the agent region includes openings of a size, shape, and configuration which are conducive to the flow of media and/or a media/agent mixture through them.

180. A device according to example 179, wherein the openings are configured normally to the surface of the agent region at the distal tip of the agent region.

181. A device according to example 179, wherein the openings are configured normally to the surface of the agent region laterally around the agent region and/or at the distal tip of the agent region.

182. A device according to example 179, wherein the shape and/or size of the openings changes when the device is positioned on the second device and the device is in use in order to facilitate the flow of media and/or a media/agent mixture.

183. A device according to example 179, wherein the openings are configured at non-normal angles to the surface of the agent region.

184. A device according to example 183, wherein the openings are configured at angles parallel with the tool pull direction if the device is manufactured with an injection molding, dip-molding, casting, compression molding, extrusion molding, machining, 3D printing, or other method; or a combination thereof.

185. A device according to example 183, wherein the openings are configured to accommodate a variety of use angles.

186. A device according to example 179, wherein the openings are circular in shape.

187. A device according to example 179, wherein the openings are elliptical or rectangular in shape.

188. A device according to example 179, wherein the openings are of multiple shapes.

189. A device according to example 188, wherein the openings at the distal tip of the agent region are circular, while the openings at the sides of the agent region are elliptical and/or rectangular.

190. A device according to example 1, wherein no agent is housed in the agent region.

191. A device according to example 190, wherein an agent is coated on the external surface of the device.

192. A device according to example 190, wherein an agent is coated on the internal surface of the device.

193. A device according to example 190, wherein an agent is impregnated into the device and is consumed during use.

194. A device according to example 3, wherein an edible substance is applied to the outside of the device.

195. A device according to 194, wherein the edible substance is sweet and/or attractive to a user.

196. A device according to example 129, wherein a therapeutic is delivered to the user transdermally by the mouth or face through skin-to-skin contact.

197. A device according to example 129, wherein the device and/or the agent is/are of a variety of colors.

198. A device according to example 197, wherein the colors of the device and/or the agent are chosen to match the skin tone(s) of the user(s).

199. A device according to example 197, wherein the colors of the device and/or the agent are chosen to correspond with different therapeutics.

200. A device according to example 197, wherein the colors of the device and/or the agent are chosen to correspond with different ages of user.

201. A device according to example 129, wherein the device is of different sizes to accommodate different anatomies.

202. A device according to example 129, wherein the shape of a horizontal cross section of the first portion of the device is triangular with rounded corners.

203. A device according to example 129, wherein the shape of a horizontal cross section of the first portion of the device is in the shape of a pinched ellipse.

204. A device according to example 129, wherein the shape of a horizontal cross section of the first portion of the device is roughly circular.

205. A device according to example 129, wherein the thickness of the second region is thinner than the thickness of the first region.

206. A device according to example 205, wherein the thinness of the second region facilitates less bulkiness to be detectable in the oral cavity, and the thickness of the first region gives the device structural integrity.

207. A device according to example 129 wherein the first and second region are thin to facilitate minimization of the device's effects on sucking.

208. A device according to example 207, wherein the thickness of the first and second portions of the device are less than 1 mm.

209. A device according to example 208, wherein the first and second portion are 0.3 mm or less in thickness.

210. A device according to example 129, wherein the surface of the device is textured.

211. A device according to example 210, wherein the external surface of the device is textured like that of a woman's breast.

212. A device according to example 210, wherein features are added to the external surface of the device including one or more of bumps, ridges, pits, or any other features.

213. A device according to example 212, wherein the features increase the comfort of using the device for the user.

214. A device according to example 212, wherein the features facilitate the latching-on of the user.

215. A device according to example 210, wherein the internal surface of the device is textured like that of a human's oral cavity.

216. A device according to example 210, wherein features are added to the internal surface of the device including one or more of bumps, ridges, pits, or any other features.

217. A device according to example 216, wherein the features facilitate the secure placement of the device on the second device.

218. A device, according to example 129, wherein the device includes a substance on the internal surface of the device.

219. A device according to example 218, wherein the substance facilitates the secure placement of the device on the second device.

220. A device according to example 219, wherein the substance is a non-toxic adhesive.

221. A device according to example 129, wherein the ratio of the first cross-sectional area to the second cross-sectional area gets larger after the device is positioned for use.

222. A device according to example 129, wherein the device contains sensors.

223. A device according to example 222, wherein the sensors can determine forces, pressures or both during use.

224. A device according to example 223, wherein the sensors measure the user's oral vacuum during use.

225. A device according to example 223, wherein the sensors measure the pressure, force or both applied by the user's tongue during use if used.

226. A device according to example 222, wherein the sensors can determine feeding volumes.

227. A device according to example 226, wherein this determination is accomplished by measuring jaw movement.

228. A device according to example 226, wherein this determination is accomplished by measuring media flow rates.

229. A device according to example 226, wherein the sensors measure indicators for health information about the user.

230. A device according to example 129, which is reusable.

231. A device according to example 129, which is self-sterilizing.

232. A device according to example 231, which includes a microbicidal coating.

233. A device according to example 231, which includes a photoactive coating.

234. A device according to example 129, wherein the device is not harmful if ingested.

235. A device according to example 234, wherein ingesting part and/or all of the device is intended to provide therapeutic benefit to the user.

236. A device according to example 129, wherein a visible part of the device changes in appearance once used and/or once a desired dosage of the agent is released.

237. A device according to example 236, wherein the device or the agent changes in color or appearance once used.

238. A device according to example 236, wherein a visible icon, text, or symbol on the device disappears or appears once used.

239. A device according to example 129, wherein part or all of the material of the device is biodegradable.

240. A device according to example 239, wherein the device material incorporates a biodegradable polymer.

241. A device according to example 239, wherein the device is made up of in whole or in part poly(lactic-co-glycolic acid).

242. A device according to example 129, wherein part or all of the material of the device has a suitability for burning or recyclability.

243. A device according to example 129, wherein the thickness of the device is less than 1 mm.

244. A device according to example 12, wherein the device is disposable.

245. A device according to example 244, wherein the device is self-destroying or self-limiting after use.

246. A device according to example 245, wherein the device changes shape to prevent further reuse after use.

247. A device according to example 246, wherein the device loses structural integrity after use.

248. A device according to example 247, wherein the device incorporates milk, water or oil soluble compounds.

249. A device according to example 244, wherein the sensory or organoleptic experience for the user is changed after use to discourage reuse.

250. A device according to example 249, wherein the smell or taste of the device for the user is changed after use to discourage reuse.

251. A device according to example 244, wherein the device makes a sound when re-used.

252. A device according to example 129, wherein the device is made up of biological material in whole or in part.

253. A device according to example 129, wherein the device is made up of a polymer, in whole or in part.

254. A device according to example 253, wherein the device is made up in whole or in part of silicone, low-density polyethylene, polypropylene, polystyrene, nylon, or other polymers which could have various chain lengths.

255. A device according to example 254, wherein the device is made of a combination of polymers.

256. A device according to example 254, wherein a portion or all of the device is made up of an emulsion of polymers, such as latex.

257. A device according to example 129, wherein the device is made in whole or in part by injection molding, dip-molding, casting, compression molding, extrusion molding, machining, 3D printing, or other methods; or a combination thereof.

From the foregoing, it will be appreciated that specific embodiments of the technology have been described herein for purposes of illustration, but that various modifications may be made without deviating from the scope of the technology. Accordingly, the technology is not limited except as by the appended claims.

We claim:

1. A device for delivering an agent orally to a child breastfeeding from a breast, the device comprising:

a broad breast portion configured to be positioned adjacent to and/or in contact with the breast during breastfeeding; and a nipple portion, wherein the entire nipple portion has a thickness that is less than a thickness of the breast portion, wherein the thickness of the nipple portion is about 0.3 mm or less, and wherein the nipple portion includes— a neck region extending from the breast portion, wherein the neck region has a first-cross sectional area that is at least great enough to surround and engage a circumference of a nipple of the breast; and a bulbous region extending from the neck region, wherein the bulbous region defines a chamber configured to house the agent, and wherein the bulbous region has a second cross-sectional area greater than the first cross-sectional area;

wherein, during breastfeeding—breast milk flows distally from the nipple through at least the bulbous region of the nipple portion and into a mouth of the child, and the neck region sealingly engages the nipple to inhibit proximal flow of the breast milk and/or the agent from the nipple portion, past the neck region, and to the breast portion.

2. The device of claim 1 wherein the bulbous region has a ball-shape.

3. The device of claim 1 wherein the bulbous region includes a plurality of openings extending therethrough.

4. The device of claim 1 wherein the nipple portion is integral with the breast portion.

5. The device of claim 1 wherein the nipple portion is detachably coupled to the breast portion.

6. The device of claim 1 wherein the nipple portion is made of a first material, and wherein the breast portion is made of a second material different than the first material.

7. The device of claim 1 wherein the nipple portion does not include an annular lip between the neck region and the bulbous region.

8. The device of claim 1 wherein an outer surface of the device is textured.

9. The device of claim 1 wherein the thickness of the nipple portion is constant.

10. The device of claim 1 wherein the device is disposable.

11. The device of claim 1 wherein the bulbous region includes a distal end portion and a sidewall extending proximally from the distal end portion, and wherein the sidewall includes a plurality of openings extending therethrough.

12. The device of claim 1 wherein a thickness of the neck region is equal to or less than a thickness of the bulbous region.

13. The device of claim 1 wherein the bulbous region includes a plurality of openings extending therethrough, and wherein the nipple portion is configured to provide a continuous fluid path from the nipple through one or more of the openings during breastfeeding.

14. A device for facilitating a child breastfeeding from a breast, the device comprising:

a broad breast portion configured to be positioned adjacent to and/or in contact with the breast during breastfeeding;

a nipple portion, wherein the entire nipple portion has a thickness that is less than a thickness of the breast portion, wherein the thickness of the nipple portion is about 0.3 mm or less, and wherein the nipple portion includes— a neck region extending from the breast portion, wherein the neck region has a first-cross sectional area that is at least great enough to surround and engage a circumference of a nipple of the breast; and a bulbous region extending from the neck region, wherein the bulbous region defines a chamber, and wherein the bulbous region has a second cross-sectional area greater than the first cross-sectional area;

an agent, wherein the agent is positioned in the chamber;

wherein, during breastfeeding—breast milk flows distally from the nipple through at least the bulbous region of the nipple portion and into a mouth of the child, the agent is delivered orally to the child, and the neck region sealingly engages the nipple to inhibit proximal flow of the breast milk and/or the agent from the nipple portion, past the neck region, and to the breast portion.

15. The device of claim 14 wherein the agent is a solid having, before breastfeeding, a cross-sectional dimension greater than the first cross-sectional dimension of the neck region.

16. A device for delivering an agent orally to a child breastfeeding from a breast of a mother, the device comprising:

a broad breast portion configured to be positioned adjacent to and/or in contact with the breast during breastfeeding; and a nipple portion, wherein the entire nipple portion has a thickness that is less than a thickness of the breast portion, wherein the thickness of the nipple portion is about 0.3 mm or less, and wherein the nipple portion includes— a neck region extending from the breast portion, wherein the neck region has a first-cross sectional area that is at least great enough to surround and engage a circumference of a nipple of the breast; and a bulbous region extending from the neck region, wherein the bulbous region defines a chamber configured to house the agent, wherein the bulbous region has a second cross-sectional area greater than the first cross-sectional area, and wherein the bulbous region includes a plurality of openings extending therethrough;

wherein, during breastfeeding—breast milk flows distally from the nipple through at least the bulbous region of the nipple portion and into a mouth of the child, the neck region sealingly engages the nipple to inhibit proximal flow of the breast milk and/or the agent from the nipple portion, past the neck region, and to the breast portion, the nipple portion is configured to stretch in response to suction forces and mechanical forces exhibited by the child, and the nipple portion is configured to provide a continuous fluid path from the nipple through one or more of the openings both in response to the suction forces and mechanical forces exhibited by the child and in the absence of the suction forces and the mechanical forces.

* * * * *